US005547115A

United States Patent [19]

Ambrosius et al.

[11] Patent Number: 5,547,115

[45] Date of Patent: Aug. 20, 1996

[54] NAIL/STAPLE CLIP HOLSTER

[76] Inventors: Steven G. Ambrosius, N6955 Van Boxtel Rd., Oneida, Wis. 54155; Neil J. Van Boxtel, N4149 County Trunk U, De Pere, Wis. 54115

[21] Appl. No.: 303,164

[22] Filed: Sep. 8, 1994

[51] Int. Cl.[6] ..... A45F 5/00

[52] U.S. Cl. ..... 224/240; 224/245; 224/904; 224/673; 224/677

[58] Field of Search ..... 224/224, 225, 224/226, 228, 232, 234, 240, 242, 904, 906, 911, 912, 253; D3/215, 219, 220, 224, 228, 223, 206; 206/336, 337, 338, 340, 348

[56] References Cited

U.S. PATENT DOCUMENTS

| | | | |
|---|---|---|---|
| 1,504,927 | 8/1924 | Baust | 224/232 |
| 1,605,359 | 11/1926 | Louret | 224/232 |
| 1,670,945 | 5/1928 | Ward | 224/240 |
| 2,590,187 | 3/1952 | Langos | 224/906 |
| 3,294,298 | 12/1966 | Danielson | 224/904 |
| 4,253,593 | 3/1981 | Pattermann | 224/253 |
| 4,300,708 | 11/1981 | Patterman | 224/232 |
| 4,307,825 | 12/1981 | Pattermann | 224/904 |
| 4,720,030 | 1/1988 | Petrovich | 224/232 |
| 5,146,684 | 9/1992 | Hagler | D3/220 |
| 5,181,637 | 1/1993 | Santilli | 206/338 |

FOREIGN PATENT DOCUMENTS

| | | | |
|---|---|---|---|
| 2689803 | 10/1993 | France | 224/904 |

*Primary Examiner*—Henry J. Recla
*Assistant Examiner*—Gregory M. Vidovich
*Attorney, Agent, or Firm*—Reinhart, Boerner, Van Deuren, Norris & Rieselbach, s.c.

[57] ABSTRACT

A holster for holding clips of fasteners for fastening application by power tools used in the construction trades. The holster includes a substantially rigid, hollow, upright pouch for vertical storage of the fasteners, said pouch having a substantially rectangular horizontal cross-section, a back wall extending upwards and having means for attaching the holster to a worker, and an angled bottom side having a hole at its lowest point, through which moisture and debris may exit the pouch.

12 Claims, 2 Drawing Sheets

NAIL/STAPLE CLIP HOLSTER

BACKGROUND OF THE INVENTION

This invention relates generally to holsters for holding fasteners and, more particularly, to holsters useful for holding clips of fasteners, such as nails, staples, rivets, bolts or screws, used in power nailers or staplers in the construction industry.

Construction workers, particularly those working on wood frame buildings, typically use power nailers and staplers in their trade. The nails and staples used in these tools are formed into "clips" that normally contain dozens of nails or staples each. These clips are loaded into a tool and fed automatically thereby so that the nails or staples in the clip are dispensed individually by the tool. On a construction site, clips are typically stored at one location. When a worker uses up all of the clips in his possession, he must return to that storage location to obtain new clips. As a result, a worker who can carry more clips on his person without creating a safety hazard can spend more time working, and less time traveling to and from the clip storage location.

Because a worker's hands must be free to operate his tools, clips are normally carried in, or attached to, the worker's clothing. The storage capacity of the average shirt, pants or jacket pocket is inadequate to hold many clips; and the design of these pockets does not usually allow the worker easy access to clips stored therein. Accordingly, construction workers most often carry their clips in a cloth or leather "nail apron". Nail aprons were originally designed to hold loose nails. They have a large pocket with the capacity to hold numerous clips, and a wide enough opening to allow easy access to the clips.

Because such aprons were not designed with clips in mind, however, the pocket is not shaped so as to hold clips securely, or in any sort of orderly configuration. As a result, clips held in nail aprons can often fall out of the apron pocket when the worker moves, and such clips are awkward for the worker to grasp when they are needed to refill a tool. Also, because the clips in a nail apron pocket strike against each other as the worker moves, the clips often break apart into partial clips and/or individual nails or staples making their use more difficult or impossible. Most power nailers and staplers cannot in fact use individual nails or staples, and all such tools are typically less efficient when loaded with partial clips.

A specialized holster designed to avoid the problems described above has long been needed in the construction industry, but this need has gone unmet until the development of the present invention.

It is therefore an object of the invention to provide a new and improved holster for use by construction workers for carrying and accessing clips of fasteners, such as nails and/or staples.

It is a further object of the present invention to provide a new and improved holster that allows swift and easy removal of individual clips.

It is yet another object of the present invention to provide a new and improved holster that minimizes the impact caused amongst the clips stored therein when a worker wearing the holster moves, thus reducing breakage of the clips.

Other advantages and features of the invention will become apparent from the following detailed description when taken in conjunction with the accompanying drawings described herein below.

DETAILED DESCRIPTION OF PREFERRED EMBODIMENTS

Figure 2:
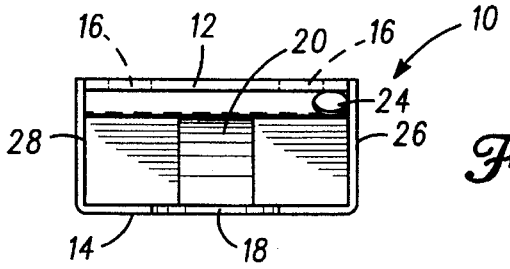
FIG. 2 shows a top view of the nail holster shown in FIG. 1.
Figure 1:
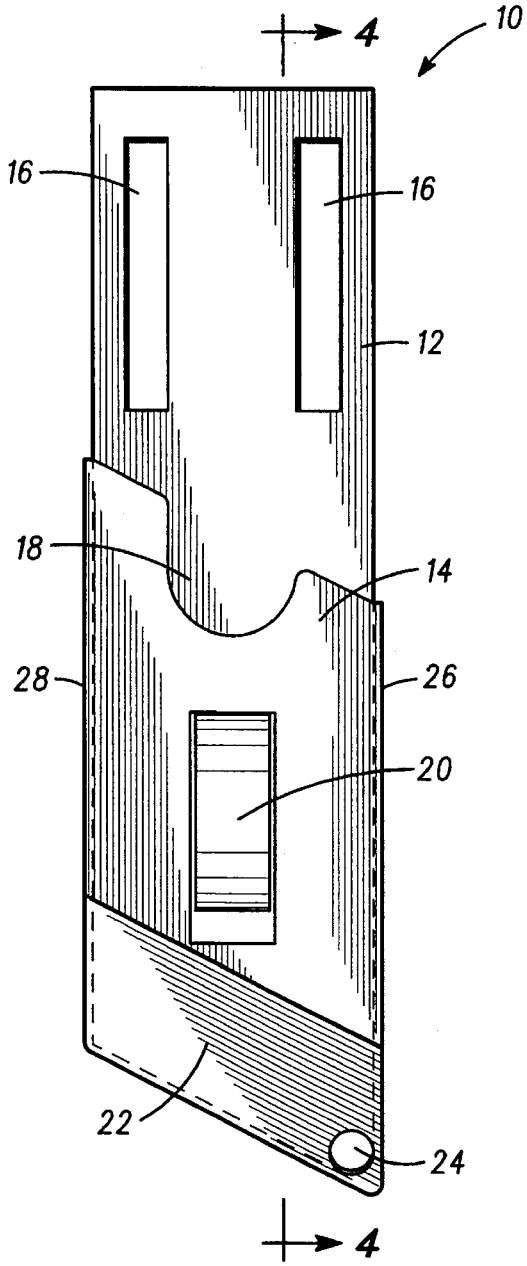
FIG. 1 illustrates a front view of a nail holster configured in accordance with the invention.
Figure 3:
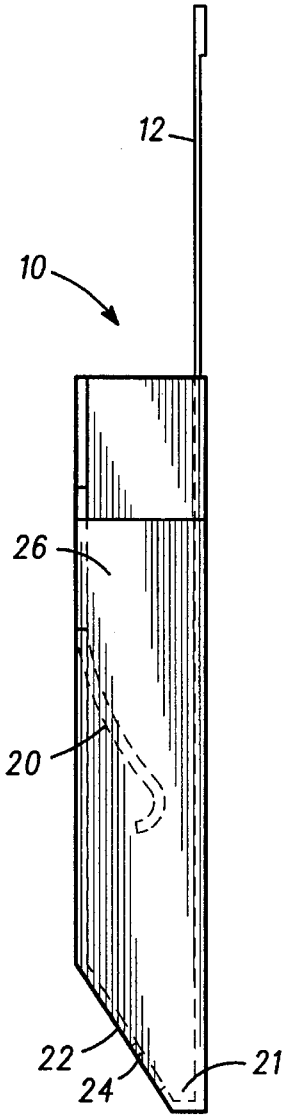
FIG. 3 illustrates a side view of the nail holster shown in FIG. 1.
Figure 4:
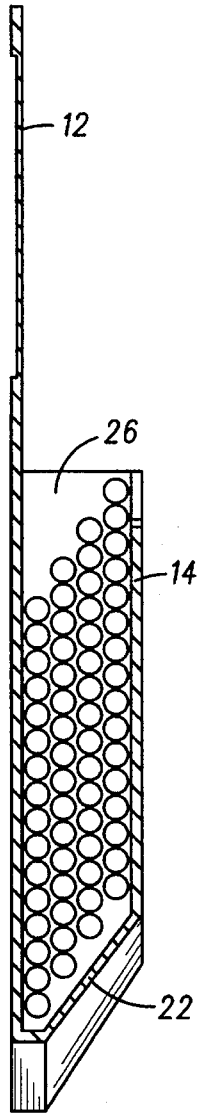
FIG. 4 shows a cross sectional view of the nail holster taken along section 4—4' in FIG. 1.
Figure 6:
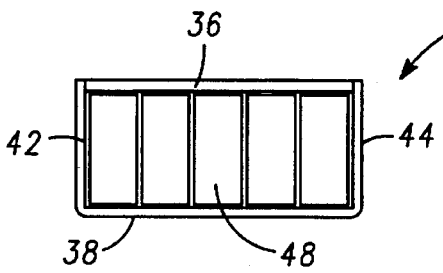
FIG. 6 shows a top view of the staple holster of FIG. 5.

Referring to the figures, and more particularly to FIG. 1, a preferred nail clip holster is illustrated at 10. In this nail clip holster 10 (hereinafter "holster 10"), back wall 12 extends up beyond front wall 14 (see also FIGS. 2 and 4), first side wall 26 and second side wall 28, and contains belt slots 16 to allow the holster 10 to be attached to a worker's belt. The upper edge of the front wall 14 is angled to match the downward angle of the joined lower edges of the front wall 14 and bottom 22 (see FIGS. 1 and 3). The bottom 22 of the pouch portion of the holster 10 is angled in two planes, both left to right and front to back, so that the right edge of the bottom 22 is lower than the left edge and the back edge is lower than the front edge. The angled nature of the bottom 22 allows gravity to move nail clips 30 in the holster 10 into an orderly cluster starting at the lowest point of the holster 10, back right corner 21. This orderly cluster in turn allows easy removal of the nail clips 30 from the holster 10 by the worker wearing the holster 10. The angled nature of the bottom 22 also allows gravity to move any moisture or debris that may be in the holster 10 down to the lowest point of the holster 10, at which the unwanted material can leave the holster 10 through opening 24. The opening 24 is large enough to allow moisture or debris to exit the holster 10, but small enough to prevent nail clips from exiting therethrough. The upper edge of the front wall 14 contains a notch 18 to allow easy access to the nail clips 30. A tensioning flap 20 may be used to hold the nail clips 30 in place in the holster 10 even when the holster 10 is less than entirely filled with nail clips 30. This is accomplished by keeping the nail clips 30 pressed against the back wall 12.

Figure 5:
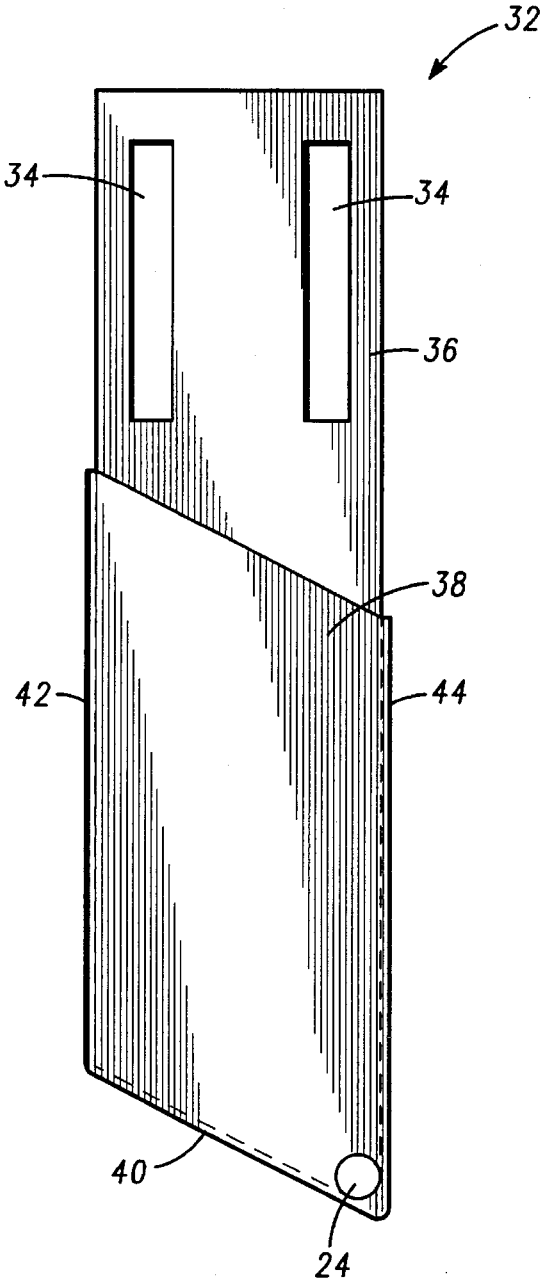
FIG. 5 illustrates a front view of one form of staple holster, embodying various features of the invention.
Figure 7:
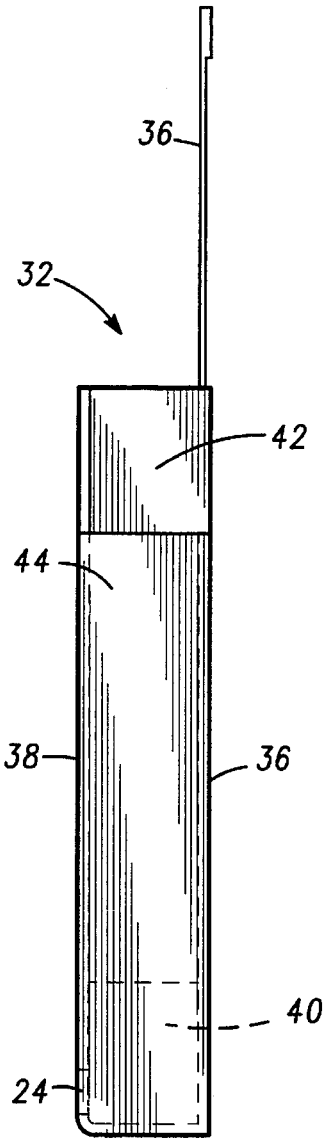
FIG. 7 illustrates a side view of the staple holster of FIG. 5.

Referring again to the figures, and more particularly to FIG. 5, a preferred staple clip holster is illustrated at 32. The design of this staple clip holster 32 (hereinafter "holster 32") differs from the design of the holster 10 in the following ways: any tensioning flap is attached to side wall 42 instead of the front wall 38, the notch is in the upper edge of side wall 44 instead of the upper edge of front wall 38, and bottom 40 is angled only in a single plane—left to right. These changes are due to the fact that the nail clips 30 described hereinbefore are typically much longer than staple clips 48. Because of their length, the nail clips 30 are held laterally in the holster 10. The shorter staple clips 48 are held transversely in the holster 32. Because a single one of the staple clips 48 will extend the entire distance from front wall 38 to back wall 36 of holster 32, no front-to-back angling of the bottom 40 is necessary, and any tensioning flap used in holster 32 must be attached to side wall 42.

While there have been disclosed what are considered to be the preferred embodiments of the present invention, it is understood that various changes in details may be made without departing from the spirit and scope of the invention, or sacrificing any of the advantages of the present invention.

What is claimed is:

1. A holster for holding clips of fasteners for fastening application by power tools used in the construction trades, comprising:

a substantially rigid, hollow, upright pouch for vertical storage of the fasteners;

said pouch having a front wall, a back wall, two side walls, and a bottom portion and further having a substantially rectangular horizontal cross-section;

said back wall extending upwards further than said side walls and said front wall and having means for attaching the holster to a worker;

said front wall having an angled lower edge with respect to a horizontal plane and said bottom portion having an upper edge, said lower edge of said front wall being joined to the upper edge of the bottom portion; said bottom portion further having an angled lower edge with respect to the plane, said lower edge of said bottom portion being joined to said back wall;

said bottom portion having a hole at its lowest vertical point, thereby allowing dirt, water and other debris to drain from said pouch, and said lower edge of said bottom portion being attached to said back wall at a vertical point lower than a second vertical point at which said upper edge of said bottom portion is attached to said front wall; and each of said side walls being substantially the same length and having substantially horizontal upper edges which join said from wall and said back wall to form substantially 90 degree angles and each of said side walls further having one side edge longer than the opposing side edge defining a substantially angled bottom edge, said longer one side edge being attached to said back wall, and said shorter second side edge being attached to said front wall, and with said side walls being attached to said back wall so that one of said upper edges of said side walls is attached at a higher point on said back wall than the other of said upper edges of said side walls, and with each of said side walls being attached to said bottom portion along said substantially angled bottom edge.

2. The holster as described in claim 1, wherein a flap is disposed inside the upright pouch, and attached to the inside of the front wall, thereby providing a means for exerting pressure on the fastener clips in said pouch to keep said fastener clips snug against the inside of the back wall.

3. The holster as described in claim 1, wherein the from wall includes a notch cut into the upper edge of said front wall.

4. The holster as described in claim 1, wherein the back wall extends downwards further than the front wall.

5. The holster as described in claim 1, wherein the front wall's lower edge is angled such that said lower edge forms an angle greater than 100 degrees with one side edge of said front wall, and an angle less than 80 degrees with the other side edge of said front wall.

6. The holster as described in claim 1, wherein the fasteners include nails.

7. A holster for holding clips of fasteners for fastening application by power tools used in the construction trades, comprising:

a substantially rigid, hollow, upright pouch for vertical storage of the fasteners;

said pouch having a front wall, a back wall, two side walls, and a bottom portion and further having a substantially rectangular horizontal cross-section;

said back wall extending upwards further than said side walls and front wall and having means for attaching the holster to a worker;

said front wall having an angled lower edge with respect to a horizontal plane and said bottom portion having an upper edge, said lower edge of said front wall being joined to the upper edge of the bottom portion; said bottom portion further having an angled lower edge with respect to the plane, said lower edge of said bottom portion being joined to said back wall;

said bottom portion being angled in two planes, both left to right and front to rear, thereby allowing gravity to move fastener clips in said pouch into an orderly cluster which, in turn, allows easy removal of said fastener clips from said pouch;

said bottom portion having a hole at its lowest vertical point, thereby allowing dirt, water and other debris to drain from said pouch, and said lower edge of said bottom portion being attached to said back wall at a vertical point lower than a second vertical point at which said upper edge of bottom portion is attached to said front wall; and each of said side walls being substantially the same length and having substantially horizontal upper edges which join said front wall and said back wall to form substantially 90 degree angles and each of said side walls further having one side edge longer than the opposing side edge defining a substantially angled bottom edge, said longer one side edge being attached to said back wall, and said shorter second side edge being attached to said front wall, and with said side walls being attached to said back wall so that one of said upper edges of said side walls is attached at a higher point on said back wall than the other of said upper edges of said side walls, and with each of said side walls being attached to said bottom portion along said substantially angled bottom edge.

8. The holster as described in claim 7, wherein a flap is disposed inside the upright pouch, and attached to the inside of the front wall, thereby providing a means for exerting pressure on the fastener clips in the pouch to keep them snug against the inside of the back wall.

9. The holster as described in claim 7, wherein the front wall includes a notch cut into an upper edge of said front wall.

10. The holster as described in claim 7, wherein the back wall extends downwards further than the front wall.

11. The holster as described in claim 7, wherein the from wall's lower edge is angled such that said lower edge forms an angle greater than 100 degrees with one side edge of said front wall, and an angle less than 80 degrees with the other side edge of said from wall.

12. The holster as described in claim 7, wherein the fasteners include nails.

* * * * *